US008596497B2

(12) United States Patent
Gary

(10) Patent No.: US 8,596,497 B2
(45) Date of Patent: Dec. 3, 2013

(54) APPARATUS TO ASSURE THE WASHING OF HANDS

(76) Inventor: Nader Gary, Ruxton, MD (US)

( * ) Notice: Subject to any disclaimer, the term of this patent is extended or adjusted under 35 U.S.C. 154(b) by 32 days.

(21) Appl. No.: 13/402,173

(22) Filed: Feb. 22, 2012

(65) Prior Publication Data

US 2013/0214002 A1 Aug. 22, 2013

(51) Int. Cl.
*B67D 7/74* (2010.01)

(52) U.S. Cl.
USPC ..... 222/129; 222/94

(58) Field of Classification Search
USPC ..... 222/129, 94, 106, 206–209, 95
See application file for complete search history.

(56) References Cited

U.S. PATENT DOCUMENTS

| | | | | | |
|---|---|---|---|---|---|
| 1,704,573 | A | * | 3/1929 | Matthews | 222/207 |
| 2,089,305 | A | | 8/1937 | Stickdorn | |
| 2,641,282 | A | | 6/1953 | Hazlett | |
| 4,081,796 | A | | 3/1978 | Tabron | |
| 4,698,620 | A | | 10/1987 | Marshall | |
| 4,795,063 | A | * | 1/1989 | Sekiguchi et al. | 222/105 |
| 4,844,299 | A | * | 7/1989 | Sekiguchi et al. | 222/94 |
| 4,978,036 | A | * | 12/1990 | Burd | 222/207 |
| 5,043,013 | A | * | 8/1991 | Kluger et al. | 106/31.32 |
| 6,029,600 | A | | 2/2000 | Davis | |
| 6,211,788 | B1 | | 4/2001 | Lynn et al. | |
| 2006/0264346 | A1 | | 11/2006 | Sullivan | |
| 2008/0223413 | A1 | * | 9/2008 | Radford | 134/34 |

* cited by examiner

*Primary Examiner* — Lien Ngo
(74) *Attorney, Agent, or Firm* — Millen, White, Zelano & Branigan, P.C.

(57) ABSTRACT

A method and apparatus for assuring the washing of hands by marking the hands with ink.

17 Claims, 3 Drawing Sheets

APPARATUS TO ASSURE THE WASHING OF HANDS

The present invention relates in general to the field of maintaining sanitary areas, to a method and apparatus for helping to assure the washing of hands, and, more particularly, to doing so by marking a person's hands with an easily identifiable substance that requires washing of the person's hands to remove the substance.

In society today there are a variety of places where there is a need that people maintain clean hands. Hospitals, other health care facilities, nurseries, restaurants, and other places where people work with food are just a few obvious examples where clean hands are a matter of public safety. Hospitals are a prime example of a place where maintaining clean hands is highly important. Most of the people in hospitals are either working with sick people or are sick themselves. It is well known that the hands are a common vehicle for the spread of bacteria, viruses, and other germs, and that regular washing of the hands is the best way to prevent the spread of infectious diseases.

There is also a need to maintain clean hands in private residences, especially if there are small children or elderly people that live in or visit the residence. Physicians and the public at large have known for many years that washing ones hands regularly, and especially after leaving the restroom, is an important way of minimizing illness.

In the past restaurants, hospitals, and other public places have tried to address the problem with rules and regulations. In many of these places, signs are posted in the restroom that say roughly, "Employees must wash hands before leaving." This is obviously not a foolproof system and as such there is a need to ensure that people have sanitized their hands especially in areas where the risk of spreading disease is high. Even hands that appear to be clean can carry disease and therefore a way to mark an individuals hands who has not washed them after partaking in an activity like going to the restroom is needed. Lastly, many restroom users simply rinse their hands after using the restroom without the using any type of cleanser; this is insufficient to remove bacteria and other germs.

There are currently systems known in the art that seek to solve this problem. These systems are permanent fixtures that are complex and expensive to maintain, and many of these systems stain and ruin the clothes of the people who use them. U.S. Pat. No. 5,670,945 for example, discloses a complex sanitizing basin system that requires a person to insert both hands simultaneously to initiate the desired output signal. U.S. Pat. No. 6,029,600 discloses a system in which a tank and sprayer is permanently mounted on the back of a door. When the door handle is turned the hand is sprayed with dye. It is expected that this spraying action risks some of the spray getting on the persons clothes and also drenches in dye to such an extent that the person has to wash their hands before using the restroom in order to prevent the dye from rubbing onto their clothes while using the restroom. This frustrates the purpose of the invention because it causes people to wash their hands before, not after using the restroom, and also adds distress to those undergoing a bathroom emergency. U.S. Pat. No. 6,211,788 removes some of the problems of the spray, but still is a permanent fixture that requires installing and regular maintenance, and would not be easily transferable to a different site. U.S. Pat. Nos. 5,202,666; 4,896,144; 3,967,478; 5,610,589; 4,688,585; and 5,199,188 are all complex expensive systems with electronics, pumps, and sensors that require improvement.

There is therefore, a need for a simple, inexpensive, and disposable way to ensure that persons wash there before leaving the restroom or other location where diseases are likely to originate. Especially desirable is a system that would be inexpensive, disposable, and quickly and easily applied or transferred to any surface.

In accordance with the present invention, a method and apparatus are provided for helping to assure the washing of hands that provides advantages over prior sanitization schemes.

The advantage of the current invention is that it assures individuals will wash their hands by marking their hands with an easily identifiable substance. The invention also ensures that the substance marks only the hand and does not get on a person's clothes, jewelry, the floor, or other items in the vicinity. Furthermore, the marking mechanism is inexpensive, disposable, and easily installable and replaceable. Any surface that is capable of accepting adhesive can quickly and easily be retrofitted by simply adhering the marking mechanism to the surface.

According to one aspect of the present invention, a method is provided for helping to assure washing of the hands by marking the hands with ink that is removable by the washing of the hands with a sanitizing medium for a period of time sufficient to assure the sanitation of the hands. The ink can be any easily identifiable substance that is capable of staining the hands and is removable upon washing the hands. In another aspect of this invention a marking mechanism is provided which marks hands when touched. The marking mechanism is easily attachable and removable from solid surfaces for example: a door, a doorknob, a latch, a handle, and a flushing mechanism.

Figure 3:
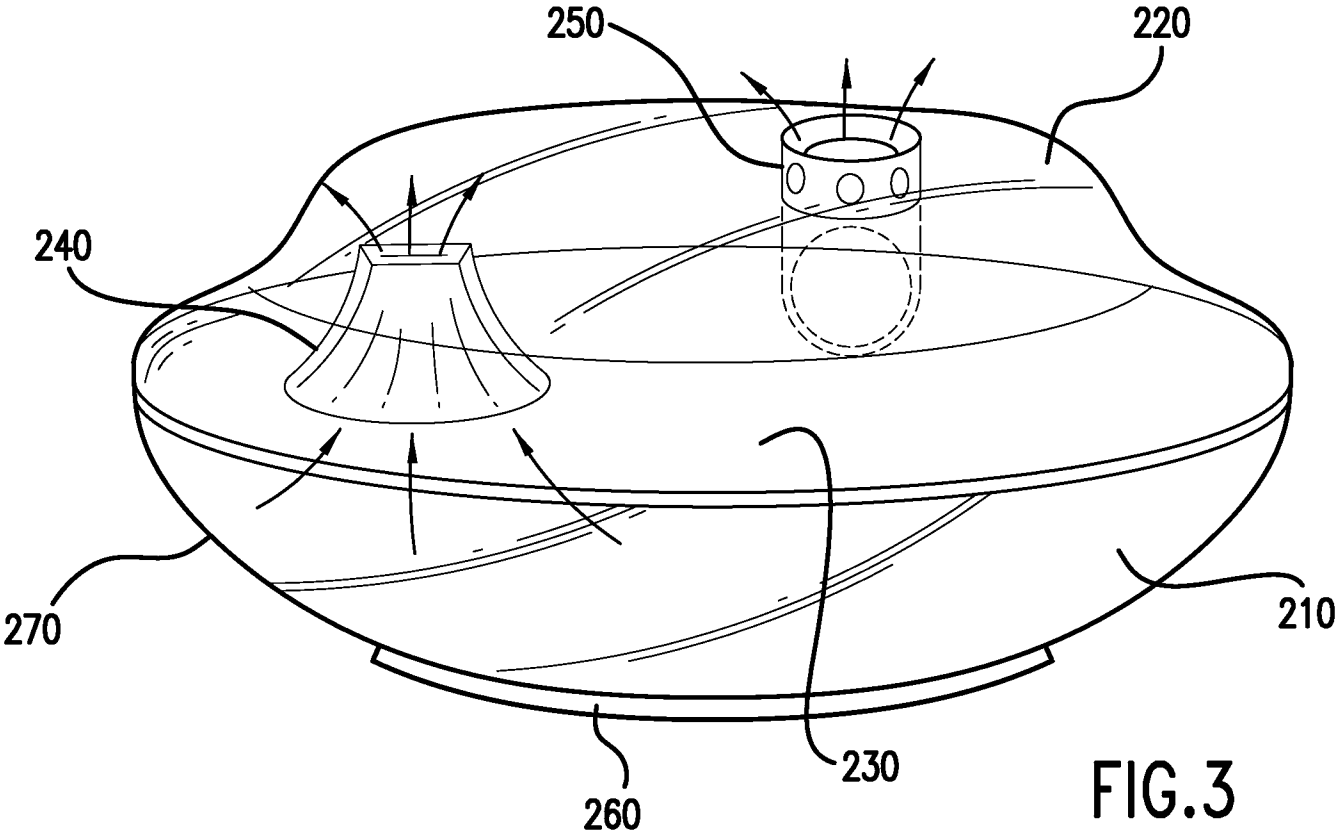

FIG. 3 a perspective view of another embodiment of the marking mechanism of the present invention.

Figure 1:
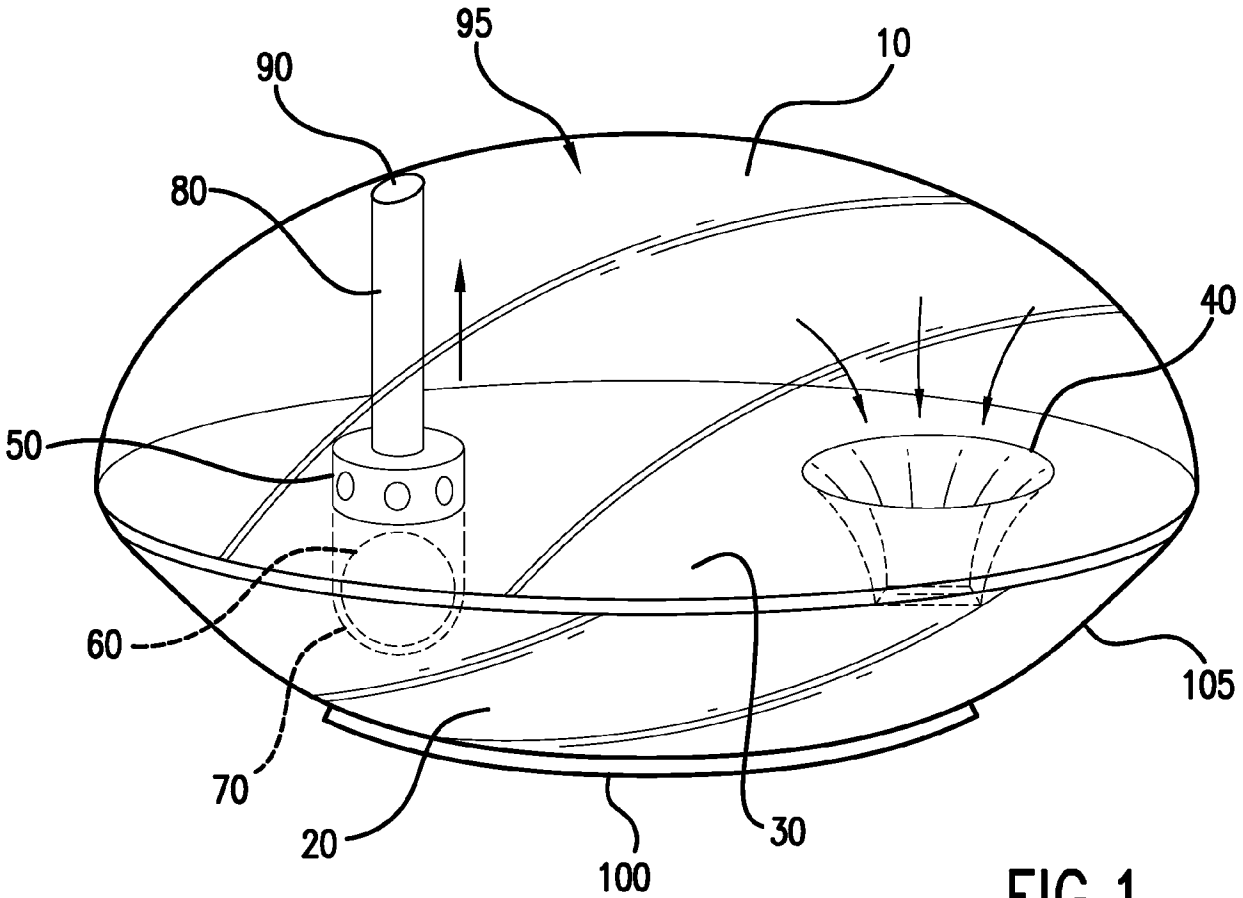
FIG. 1 shows a perspective view of an embodiment of the marking mechanism of the present invention.

FIG. 1 illustrates, a marking mechanism of the present invention. The marking mechanism is composed of two chambers, one large chamber (10) and one small chamber (20). An inter-membrane (30) separates the two chambers and contains two, one-way valves (40,50) that allow for the passage of ink. Lastly, in some embodiments of this invention a collapsible passageway (80) connects the small chamber (20) to an opening (90) in the surface (95) that is touched by the thumb, finger, or palm.

The difference in size between the two chambers (10,20) ranges from 1:5 to 1:100, small to large, respectively, and is capable of marking at least 2 hands. The small chamber (20) contains the ink that is expelled from the marking mechanism through a one-way valve (50) and marks the thumb, finger, or palm. The large chamber (10) refills the small chamber (20) with ink through a one-way valve (40). The large chamber (10) serves to store the majority of the ink and to refill the small chamber (20) with ink after the marking mechanism has been used and the small chamber (20) has expelled ink. The small chamber (20) serves to limit the amount of ink that can be expelled in each operation of the marking mechanism. In the preferred embodiment of the invention the chambers (10, 20) are open and the ink therein is stored in free flowing liquid form. In another embodiment of the invention, the chambers contain porous foam to restrict the flow of ink therein. Foam can also, optionally, be used in the collapsible passageway (80), in the embodiments that use it. Combinations of an open chamber and a porous foam chamber can also, optionally, be used.

Separating the two chambers is an inter-membrane (30) that contains a one-way valve (40) which, allows for the passage of ink from the large chamber (10) to the small chamber (20). In FIG. 1, inter-membrane (30) contains another one-way valve (50) which, allows for the flow of ink from the small chamber (20) though the collapsible passageway (80) to the orifice (90) on the surface (95) to contact a thumb, finger, or palm. Any pressure activated valve capable of being affixed to or integrated into the inter-membrane (30) that divides the two chambers is suitable for this invention. For example, as shown in FIG. 1, the valve (40) can be a tissue valve or a St. Jude valve and the valve (50) can be a ball (60) and cage (70) valve.

The marking mechanism can be made of any flexible or semi-flexible material, such as rubber, elastomeric polymer, steal, or aluminum. The two chambers (10,20), the inter-membrane (30), and the collapsible passageway (80) can be made from the same or different materials. For example the inter-membrane (30) may be made of rubber while other portions are made of aluminum or vice versa. In the preferred embodiment of the invention the entire marking mechanism is made of an elastomeric polymer such as butyl rubber, silicone, polyurethane, polyester, polyethylene, polybutylene, or similar flexible material.

The marking mechanism is activated when pressure is applied to the marking mechanism by a thumb, finger, or palm of the hand. When pressure is applied to the marking mechanism, a small amount of ink is applied though an orifice (90) in the surface (95) to the thumb, finger, or palm of the hand that applied the pressure to the marking mechanism. A small amount is defined in this context to mean less than 0.15 ml and more than 0 ml of ink, including at least 0.14 ml, 0.13 ml, 0.12 ml, 0.11 ml, 0.10 ml, 0.9 ml, 0.8 ml, 0.7 ml, 0.6 ml, 0.5 ml, 0.4 ml, 0.3 ml, 0.2 ml, 0.1 ml, 0.05 ml, 0.025 ml, or 0.01 ml.

Figure 2:
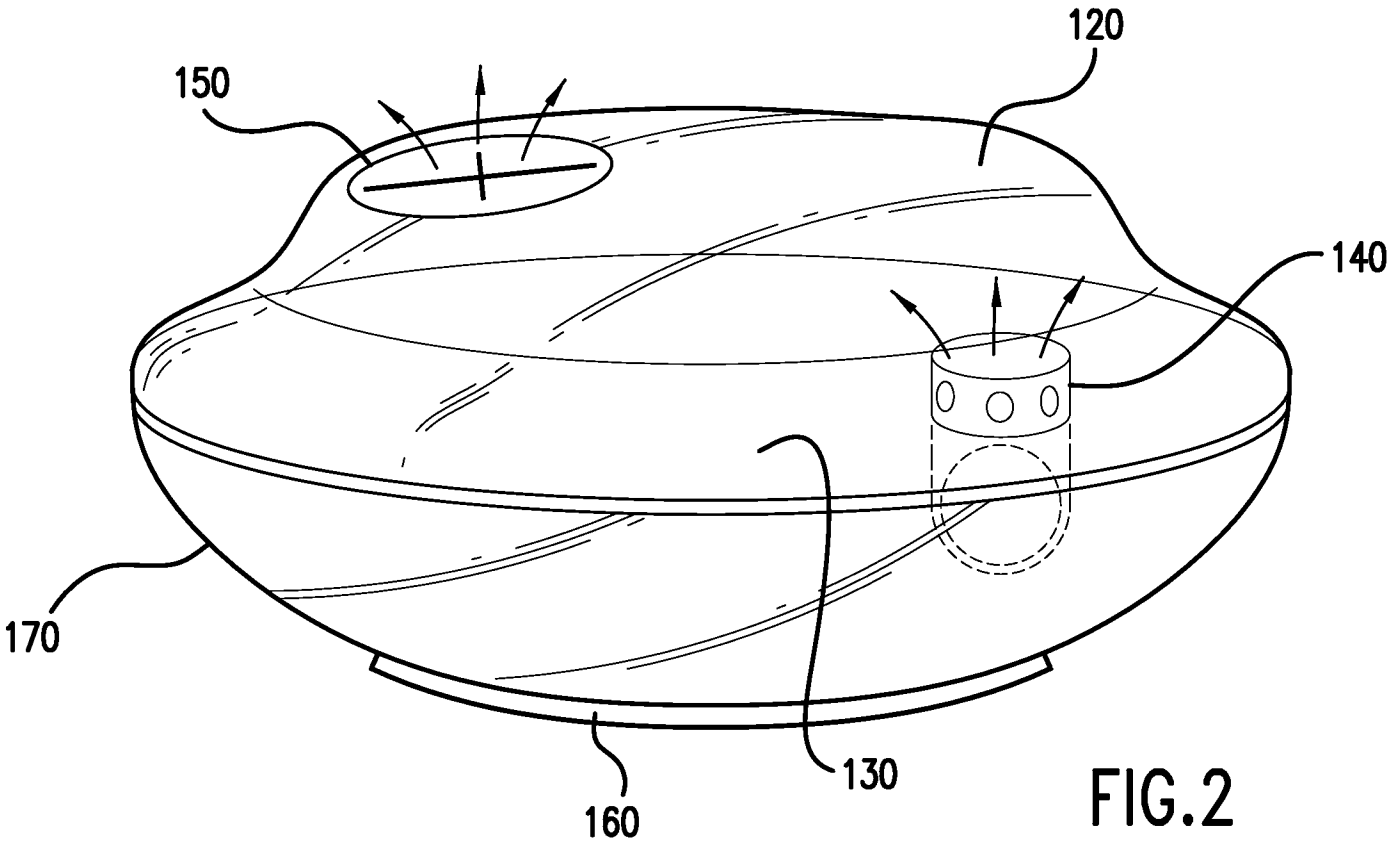
FIG. 2 shows a perspective view of another embodiment of the marking mechanism of the present invention.

Pressure from the thumb, finger, or palm causes the chambers to compress and expel the ink from the small chamber (20) onto the thumb, finger, or palm though the one-way valve (50) that closes after pressure is applied. When pressure is applied to the marking mechanism in the preferred embodiment a small amount of ink is allowed to pass though the one-way valve (50), such as a ball (60) and cage (70) valve, before the valve closes because the small chamber (20) is continuously filled with ink by the large chamber (10), until it empties. The ball (60) and cage (70) valve (50) must allow the ink in front of the ball (60) into the collapsible passageway (80) for the ball (60) to move into the closed position. In the preferred embodiment this small amount of ink travels though the collapsible passageway (80) onto the finger though a orifice (90) in the surface (95). In other embodiments the ink may pass from the small chamber (120,220), through a one-way valve (150,250), directly onto the thumb, finger, or palm. In the embodiments, as illustrated in FIGS. 2 and 3 ink passes from the small chamber (120,220), through a one-way valve (150,250), directly onto the thumb, finger, or palm when pressure is applied to the small chamber (120,220) from the thumb, finger, or palm and the ink from the large chamber (110,210) passes into the small chamber (120,220) though a one-way valve (140,240), embedded in the inter-membrane (130,230), that insures the small chamber (120,220) is continuously filled with ink by the large chamber (110,210) until it empties.

The mechanism preferably has a means for temporarily affixing (100,160,260) itself to the desired surface which optionally includes, adhesive or a hook and loop fastener such as Velcro. The means for temporarily affixing (100,160,260) the mechanism is located on the back of the mechanism (105,170,270) which, may be optionally coated with adhesive or double sided tape that can be applied to the back and bonded to the chosen surface. Alternatively, half of a hook and loop fastener such as Velcro can be attached to the surface by way of adhesive and then the other half of the hook and loop fastener such as Velcro can be attached or simply manufactured into the back of the marking mechanism.

Though any ink can be used in the mechanism the preferred embodiment uses ink that is only soluble in alcohol. The ink could therefore only be removed by washing one's hands in an alcohol-based skin cleanser, such as Purell or a soap alcohol mixture.

A method of this invention comprises: a) positioning onto a surface touched by a hand, a marking mechanism which retains ink, b) touching a surface of said marking mechanism with a hand to increase the pressure in said marking mechanism, and c) releasing a portion of the ink retained in the marking mechanism in response to the increase in pressure in said marking mechanism. The portion of ink released is released at the surface of said marking mechanism touched by said hand. In certain preferred embodiments the marking mechanism is adhered to a surface touched by a hand. In other preferred embodiments the portion of ink released is metered to be less than 19 ml, 18 ml, 17 ml, 16 ml, 15 ml, 14 ml, 13 ml, 12 ml, 11 ml, 10 ml, 9 ml, 8 ml, 7 ml, 6 ml, 5 ml, 4 ml, 3 ml, 2 ml, 1 ml, 0.5 ml, 0.25 ml, or 0.1 ml. In certain embodiments the portion of ink released is metered by transferring the ink retained in the marking mechanism to a dispensing chamber of a desired size before it is released from the marking mechanism. In certain embodiments 0.01% to 50% of the ink retained in the marking mechanism is released when a hand touches the surface. In a further adaptation of these preferred embodiments the ink is stored in a storage chamber prior to transfer to said dispensing chamber. A method of this invention may further comprise removing said marking mechanism. Such a method may further comprise disposing the removed marking mechanism from the surface on which it is positioned. A method of this invention may further comprise replacing said marking mechanism with new marking mechanism.

The invention is intended to function in a scenario like the one that follows: A person leaves the table of a restaurant and makes his or her way to the restroom. They reach for and grab the door handle or knob on the door to the restroom. As they grasp that handle or knob they operate the invention, which marks their thumb, finger, or palm with a small dot of ink. They finish using the restroom and rinse there hands off in the sink where they find the mark of ink was not removed. In response, they put some sanitizing agent on their hands and scrub until the ink has been removed. They leave the restroom and return to the table comfortable and certain that their hands are clean, and that they can eat without fear of contaminating their food. At the end of the night, a cleaning crew pulls the invention off the door, throws it away, and replaces it with a fresh new one that is ready for the next day's patrons.

Another likely scenario in which the invention is likely to function is as follows: A service worker in a restaurant or hospital goes into the restroom to perform cleaning duties or for personal use. Upon their reemergence from the restroom their employer or manager can quickly discern whether or not the employee has washed his or her hands by simply inspecting them for the dot of ink. This will decrease the likelihood of harmful germs being spread to food and/or people.

The two chambers can be encapsulated together and either chamber is optionally refillable by injection of ink. Other technical advantages should be apparent from the drawings, specification, and claims.

What is claimed is:

1. An apparatus for helping to assure the washing of a person's hands, comprising:

(a) an ink which is removable by washing of the hands;

(b) a first ink storage chamber and a second ink storage chamber, wherein the first ink storage chamber is larger than the second ink storage chamber and wherein an ink exit point is positioned on an outer surface of the first ink storage chamber; wherein the at least two chambers have at least two, one way valves wherein a first valve allows for the transfer of ink from the first chamber to the second chamber and a second valve allows for the transfer of ink from the second chamber to the ink exit point.

2. The apparatus of claim 1 wherein ink is any non-toxic liquid capable of marking a human hand and subsequently removable by way of hand washing with traditional alcohol or non-alcohol based cleansers or soaps.

3. The apparatus of claim 1 wherein the chambers are separated by an inner membrane.

4. The apparatus of claim 1 wherein the chambers are filled with foam capable of storing and releasing ink.

5. The apparatus of claim 1 wherein the ratio in the size difference between the two chambers is from 1:5 to 1:100.

6. The apparatus of claim 1 wherein .01% to 50% of the ink retained in the marking mechanism is released when activated by the application of pressure.

7. The apparatus of claim 1 wherein there is a means for temporarily affixing the apparatus to a door, a doorknob, other door opening mechanism, a toilet flushing mechanism, or urinal flushing mechanism.

8. The apparatus of claim 7 wherein the apparatus is easily removable for disposal.

9. The apparatus of claim 3 wherein at least one, one way valve is located in the inter-membrane and allows for the passage of ink from the large chamber to the small chamber; and at least one other one-way valve which is also located in the inter-membrane and is connected to a collapsible passageway wherein the collapsible passageway traverses the large chamber and connects to an outer wall of the apparatus.

10. The apparatus as in claim 9 wherein the one-way valve connected to the collapsible passageway is a ball and cage valve that operates in the open position when no pressure is applied to the apparatus and changes to the closed position when pressure is applied to the apparatus.

11. The apparatus of claim 3 wherein at least one, one-way value is located in the outer wall of the small chamber and allows for the passage of ink from the small chamber to outside the apparatus, and another one-way valve is located in the inner membrane and allows for the passage of ink from the large chamber to the small chamber.

12. The apparatus of claim 11 wherein one of the one-way valves is a ball and chain valve.

13. A method for marking a hand comprising contacting the apparatus of claim 1with a hand wherein the apparatus is adhered to a surface;

transferring a portion of the ink between chambers, and releasing said ink from said apparatus to said hand, wherein the ink is transferred at a point of contact between said hand and said apparatus, and wherein the amount of ink transferred to the hand is metered to be less than 0.15 ml and more than 0 ml.

14. A method of claim 13 further comprising removing said apparatus.

15. A method of claim 13 further comprising disposing of said apparatus.

16. An apparatus for helping to assure the washing of persons hands, comprising:

(a) an ink which is removable by washing of the hands;

(b) at least two separate, differently sized, ink storage chambers;

(c) at least two, one way values wherein first valve is capable of transferring ink between chambers and the second value is capable of transferring ink outside of the apparatus;

wherein a one way valve is located in an inter-membrane and allows for the passage of ink from a large chamber to a small chamber and another one-way valve which is also located in the inter-membrane and is connected to a collapsible passageway wherein the collapsible passageway traverses the large chamber and connects to an outer wall of the apparatus, and allows for the passage of ink from the small chamber to outside the wherein the one-way valve connected to the collapsible passageway is a ball and cage valve that operates in the open position when no pressure is applied to the apparatus and changes to the closed position when pressure is applied to the apparatus.

17. The apparatus of claim 1 wherein ink is any non-toxic liquid capable of marking a human hand and subsequently removable only by way of hand washing with alcohol based cleansers or soaps.

* * * * *